US005366077A

United States Patent [19]

Pham

[11] Patent Number: 5,366,077

[45] Date of Patent: Nov. 22, 1994

[54] HINGED-LID CIGARETTE BOXES WITH FOLD-IN LOCKS TO FACILITATE CONSISTENT LID CLOSURE

[75] Inventor: Xuan M. Pham, Richmond, Va.

[73] Assignee: Philip Morris Incorporated, New York, N.Y.

[21] Appl. No.: 94,752

[22] Filed: Jul. 20, 1993

[51] Int. Cl.[5] ..... B65D 85/10; B65D 5/66

[52] U.S. Cl. ..... 206/268; 206/273; 206/265; 229/160.1

[58] Field of Search ..... 206/265, 268, 271, 273; 229/160.1

[56] References Cited

U.S. PATENT DOCUMENTS

| | | | |
|---|---|---|---|
| 3,078,030 | 2/1963 | Gorton | 229/160.1 |
| 3,944,066 | 3/1976 | Niepmann | 206/273 |
| 4,215,810 | 9/1980 | Zicko | 229/33 |
| 4,729,508 | 3/1988 | Erdmann et al. | 206/273 |
| 4,753,383 | 6/1988 | Focke et al. | 206/273 |
| 4,852,734 | 8/1989 | Allen et al. | 206/273 |
| 4,948,038 | 8/1990 | Moeller | 206/273 |
| 4,951,862 | 8/1990 | Taddia et al. | 229/160.1 |
| 5,129,513 | 7/1992 | David et al. | 206/265 |
| 5,137,148 | 8/1992 | Evers | 206/273 |

FOREIGN PATENT DOCUMENTS

414532A1 2/1991 European Pat. Off. .

*Primary Examiner*—David T. Fidei

*Attorney, Agent, or Firm*—Kevin B. Osborne; James E. Schardt; Charles E. B. Glenn

[57] ABSTRACT

A pack has a retention member formed in the walls of the innerframe and the lid. The retention member can be tab-like extension members extending from a top edge of the innerframe and the bottom edge of the lid. When the tab-like extension member is folded into operational position, it functions to help keep the lid closed by providing additional interference between the lid and the innerframe. The retention member can also be segments of inner wall panels of the lid itself. When folded into operational position, the folded segment of the inner wall panel functions to help keep the lid closed by providing additional interference between the lid and the innerframe. Any of these retention members can be folded into operational position by the manufacturer. Alternatively, the pack can be provided to the consumer with the extension member in non-operational position, leaving to the individual consumer's discretion the decision to fold the retention member into operational position.

52 Claims, 8 Drawing Sheets

HINGED-LID CIGARETTE BOXES WITH FOLD-IN LOCKS TO FACILITATE CONSISTENT LID CLOSURE

BACKGROUND OF THE INVENTION

This invention relates to hinged-lid cigarette packs, and more particularly to hinged-lid cigarette boxes having radiused vertical edges.

Hinged-lid cigarette boxes are well known. One of the most popular forms of such boxes has an outer member which includes a lower main portion, in which the cigarettes stand vertically, and a lid. The lid is often (although not always) hinged to the back of the main portion so that the upper ends of the cigarettes are exposed when the lid is hinged back. Although such boxes are usually formed with right-angled vertical edges, the vertical edges may be rounded or radiused.

such boxes typically have an innerframe inside the main portion which extends up from the main portion into the space covered by the lid in the closed position. One important function of the innerframe is to provide some interference with the lid as it opens and closes. This interference helps to keep the lid firmly and neatly closed and reduces the risk that the lid will open accidentally. However, for the most part, the innerframe provides such interference only once the lid has opened beyond a certain point. The innerframe does not always provide interference initially. Hence the lid may not always remain completely closed with the bottom edges of the lid resting directly on the top edges of the lower main portion of the box. It is desirable for the lid to remain completely closed for the sake of appearance and neatness (e.g., so that any loose tobacco remains within the box) without damaging the contents of the box.

The provision of retention means which retain the lid in a completely closed position has previously been accomplished through the use of means such as a tab member extending substantially perpendicular to the plane of a wall of the innerframe, thereby interfering with the lid member. Such a tab member is generally formed from the standard innerframe blank such that when the tab is extended perpendicular to a wall, a cutout area remains where the tab originally had been. Furthermore, such retention means are generally formed at the front right-angled vertical edges of the innerframe. In the case of a box with rounded or radiused vertical edges, the vertical edges are rounded or radiused by multiple scoring of the blank, and the additional formation of such retention means may be difficult or impossible.

It would be desirable to be able to provide a retention means which retains the lid in a completely closed position on a cigarette box yet does not damage the contents of the cigarette box.

It also would be desirable to be able to provide a retention means formed from a standard blank, i.e., which does not require a deviation from the standard shape of a blank, yet does not leave a visible cutout area once it is moved into retaining position.

It would further be desirable to be able to provide a retention means which does not alter the appearance of the cigarette box after multiple openings and closings of the cigarette box.

It would still further be desirable to be able to provide a retention means which is not formed at the vertical edges of the innerframe to facilitate formation of such retention members on boxes with rounded or radiused vertical edges.

SUMMARY OF THE INVENTION

It is therefore an object of this invention to provide a retention means which retains the lid in a completely closed position on a cigarette box, yet does not damage the contents of the cigarette box.

It is another object of this invention to provide a retention means formed from a standard blank, i.e., which does not require a deviation from the standard shape of a blank, yet does not leave a visible cutout area once it is moved into retaining position.

It is another object of this invention to provide a retention means which does not alter the appearance of the cigarette box after multiple openings and closings of the cigarette box.

It is yet another object of this invention to provide a retention means which is not formed at the vertical edges of the innerframe to facilitate formation of such retention members on boxes with rounded or radiused vertical edges.

These and other objects of the invention are accomplished in accordance with the principles of the invention by cutting (e.g., with a die cut) a blank for a cigarette box to include at least one and preferably two retention members included in the portion of the blank which when folded constitutes either the lid or the innerframe of the cigarette box. In the first embodiment, when the blank is folded to form the box, extension-type retention members extend vertically downward from the side edges of the lid. The extension-type retention members may be folded about a perforated hinge-line into the inside of the lid so that they are substantially adjacent to the inside surface of the lid. Folding of the retention members may be performed by the manufacturer (e.g., using appropriate machinery) or by the consumer. If the folding is performed by the manufacturer, the folded retention members may be secured (e.g., with glue) to the inside surface of the lid. Once the extension-type retention members are folded into the lid, they serve to keep the lid tightly closed.

In the second embodiment, when the blank is folded, right and left inner lid side wall panels are formed on the inside walls of the right and left side walls of the lid, respectively. Each of the inner lid side wall panels has a predetermined inner surface which eventually faces the interior of the box. Retention members may be formed by folding the lower corners of the inner lid side wall panels inward along perforated hinge-lines traversing the widths of the inner lid side wall panels, so that the folded lower corners are substantially adjacent to the inner surfaces of the inner lid side wall panels. Folding of the retention members formed by the lower corners of the inner lid side wall panels may be performed by the manufacturer (e.g., using appropriate machinery) or by the consumer. If the folding is performed by the manufacturer, the folded lower corners of the inner lid side wall panels may be secured (e.g., with glue) to the inside surfaces of the unfolded portions of the inner lid side wall panels. Once the lower corners of the inner lid side wall panels have been folded, they serve to keep the lid tightly closed.

In the third embodiment, when the blank is folded to form the box, extension-type retention members extend vertically upward from the side edges of the innerframe. The extension-type retention members may be folded about a perforated hinge-line so that they are substantially adjacent to the outside surface of the innerframe. Folding of the retention members may be performed by the manufacturer (e.g., using appropriate machinery) or by the consumer. If the folding is performed by the manufacturer, the folded retention members may be secured (e.g., with glue) to the outside surface of the innerframe. Once the extension-type retention members are folded, they serve to keep the lid tightly closed.

BRIEF DESCRIPTION OF THE DRAWINGS

The above and other objects and advantages of the invention will be apparent upon consideration of the following detailed description, taken in conjunction with the accompanying drawings, in which like reference numbers refer to like parts throughout, and in which.

DETAILED DESCRIPTION OF THE INVENTION

This invention is a hinged-lid cigarette box with fold-in locks to facilitate consistent lid closure. Retention members are provided in the lid of the box or on the innerframe of the box. When these retention members are folded into position and the lid is closed, the folded retention members cause an additional interference between the lid and the innerframe of the box which serves to keep the lid in a closed position.

Figure 1:
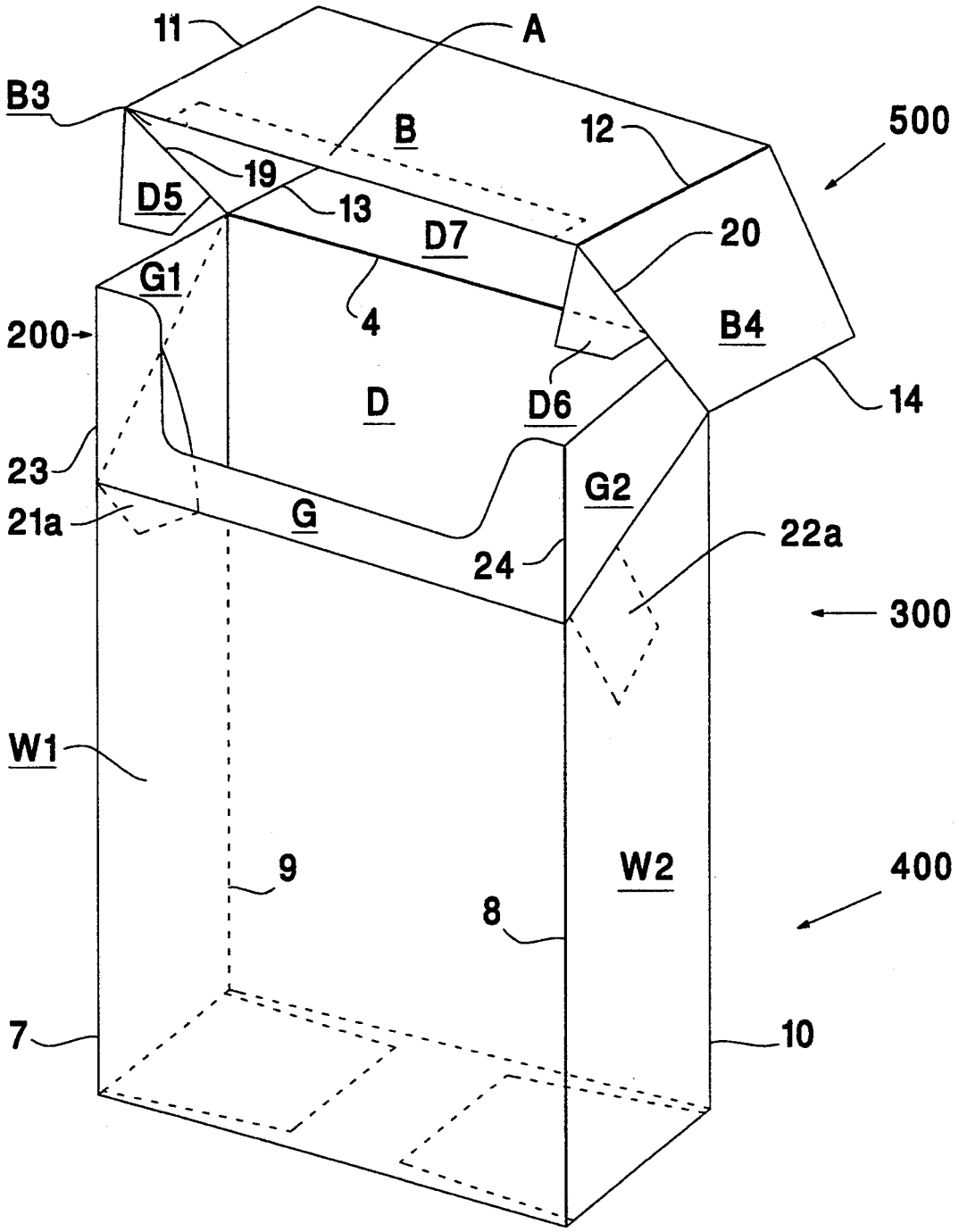
FIG. 1 is an isometric view of a hinged-lid cigarette pack with the top or lid pivoted back, having extension-type retention members in accordance with this invention in an unfolded, non-operational position.

A cigarette pack having extension-type retention members D5 and D6 in accordance with this invention is generally shown in FIG. 1. Cigarette pack 300 includes a lower main portion 400, a lid 500, and an innerframe 200, all of conventional paperboard (e.g., 0.012 inch (0.305 millimeter) thick paperboard). Vertical edges 23, 24, 7, 8, 9, 10, 11, 12, 13, and 14 are rounded or radiused, preferably by multiple parallel scoring of the blank. The radius of curvature of each of these edges may be approximately 5/32 inch (0.40 centimeter). Lower main portion 400 has a double-ply left side wall W1 and a double-ply right side wall W2. The inner ply of left side wall W1 forms the inner surface of left side wall W1. The outer ply of left side wall W1 forms the outer surface of left sidewall W1. Likewise, the inner ply of right side wall W2 forms the inner surface of right side wall W2 while the outer ply of right side wall W2 forms the outer surface of right side wall W2. Innerframe 200 has front wall G, left side wall G1 and right side wall G2 all of which have inner and outer surfaces. Lid 500 is typically hinged along hinge line 4 to lower main portion 400. Lid 500 has a double-ply left lid side wall B3 and a double-ply right lid side wall B4, front wall B, and rear wall D7. Lid front wall B and lid rear wall D7 have outer and inner surfaces. The inner ply of left lid side wall B3 forms the inner surface of left lid side wall B3. Likewise, the inner ply of right lid side wall B4 forms the inner surface of right lid side wall B4. Lid front wall B is reinforced by lid front wall reinforcement panel A. Innerframe 200 is attached (e.g., with glue) to the inside of lower main portion 400, and extends at least partially above the top of lower main portion 400. When lid 500 is closed, it fits down over and completely covers the portion of innerframe 200 which projects above lower main portion 400. Innerframe 200 is a structural member which interferes somewhat with lid 500 as the lid is opened and closed. This interference reduces the risk of the pack opening by accident. Extension-type retention members D5 and D6 are typically hinged along hinge lines 19 and 20, respectively. When extension-type retention members D5 and D6 are folded inward about hinge lines 19 and 20, respectively, such that they are substantially adjacent to the inner surfaces of lid side walls B3 and B4, respectively, they provide additional interference between the inner surface of lid 500 and the outside surface of innerframe 200 to keep the lid firmly closed and resting on the top of the lower main portion 400, hence keeping the lid from opening accidentally.

Slots 21*a* and 22*a* are provided in the inner ply of side walls W1 and W2, respectively, of lower main portion 400. In the event the box is provided to the consumer with extension-type retention members D5 and D6 in non-operational position, extension-type retention members D5 and D6 fit into slots 21*a* and 22*a*, respectively, when lid 500 is closed.

Figure 2:
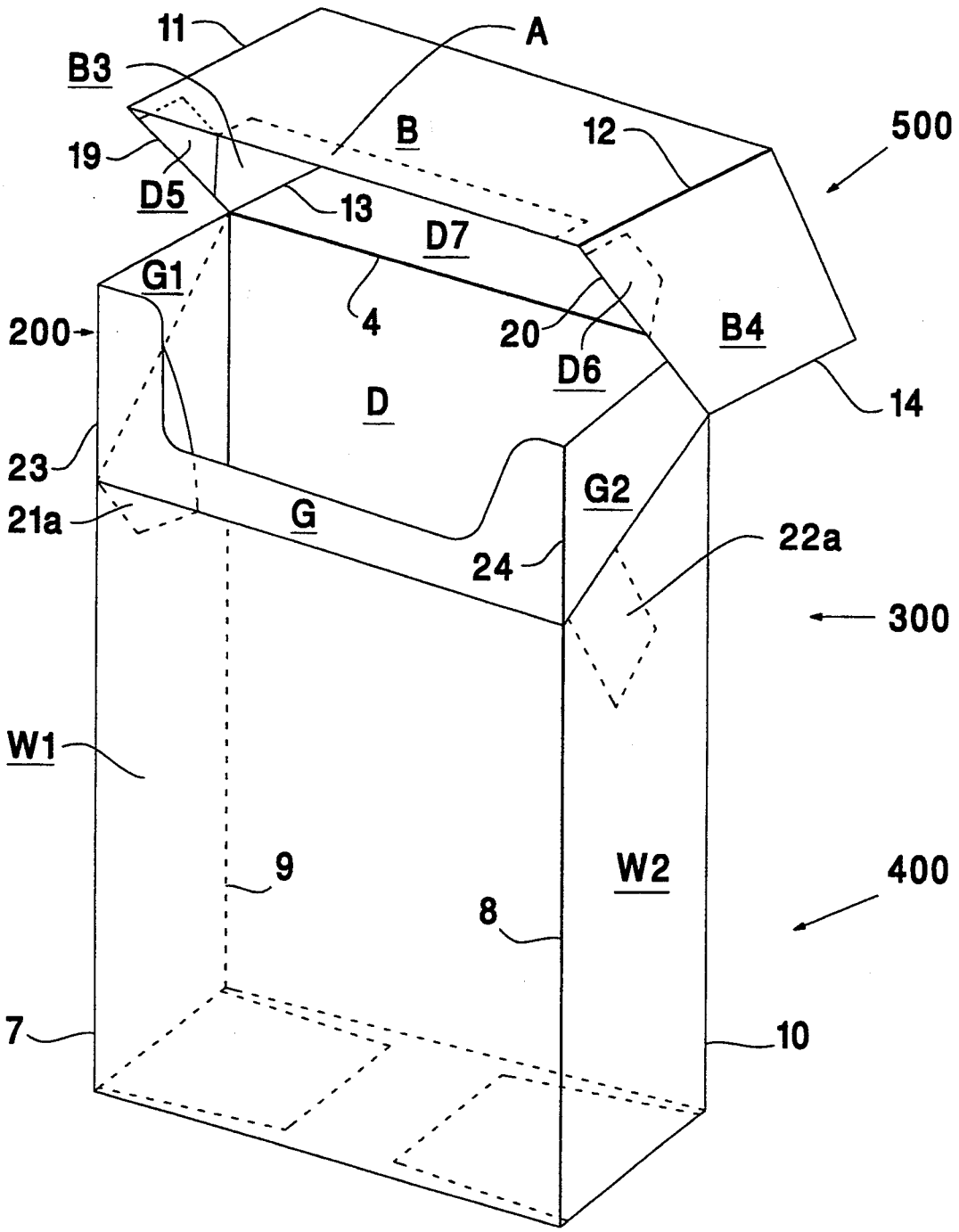
FIG. 2 is an isometric view of a cigarette pack with the top or lid pivoted back, having extension-type retention members in accordance with this invention in operational position.

An illustrative cigarette pack with the extension-type retention members of the first embodiment folded into operational position is shown in FIG. 2.

Figure 3:
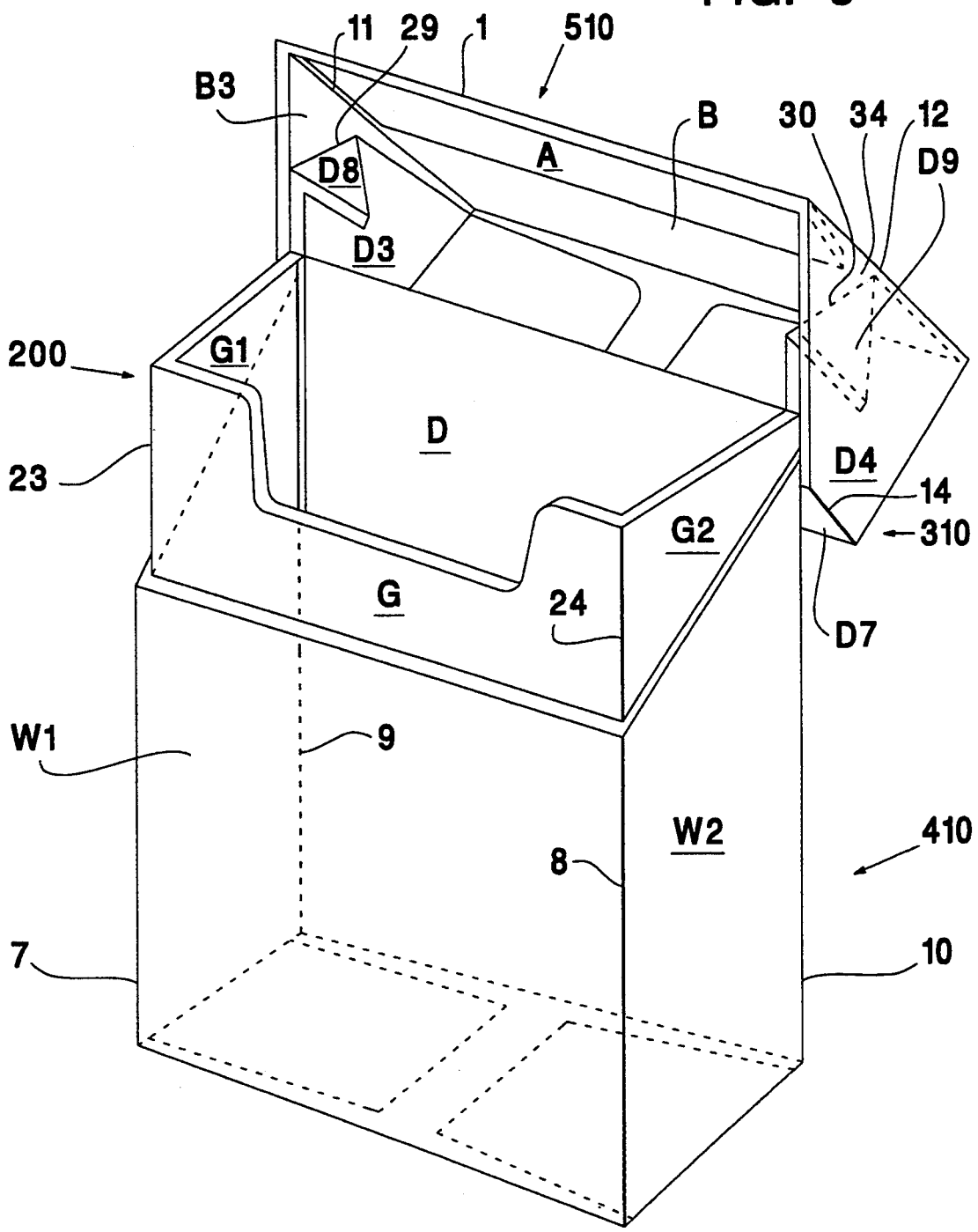
FIG. 3 is an isometric view of a cigarette pack with the top or lid pivoted back, having retention members in accordance with this invention in operational position.

A second embodiment of this invention is shown as cigarette pack 310 in FIG. 3 and is otherwise the same as FIG. 1 except for the following differences: extension-type retention members D5 and D6 are not present in lid 510 of cigarette pack 310. Slots 21*a* and 22*a* are not present in lower main portion 410 of cigarette pack 310. In lid 510, the inner ply of left lid side wall B3 is left inner lid side wall D3 and the inner ply of right lid side wall B4 is right inner lid side wall D4. Inner lid side walls D3 and D4 both have inner surfaces that face the interior of the cigarette box. Lid 510 has retention members D8 and D9 which are segments of the respective inner lid side walls D3 and D4. Hinge lines 29 and 30 traverse the widths of inner lid side walls D3 and D4, respectively. Retention members D8 and D9 fold inward about hinge lines 29 and 30, respectively, so that retention members D8 and D9 are substantially adjacent to the inner surfaces of inner lid side walls D3 and D4, respectively. When folded into position, retention members D8 and D9 provide additional interference between the inside surface of lid 510 and the outside surface of innerframe 200 to keep the lid firmly closed and resting on the top of the lower main portion 410, hence keeping the lid from opening accidentally. FIG. 3 shows retention members D8 and D9 already folded into operational position.

Figure 4:
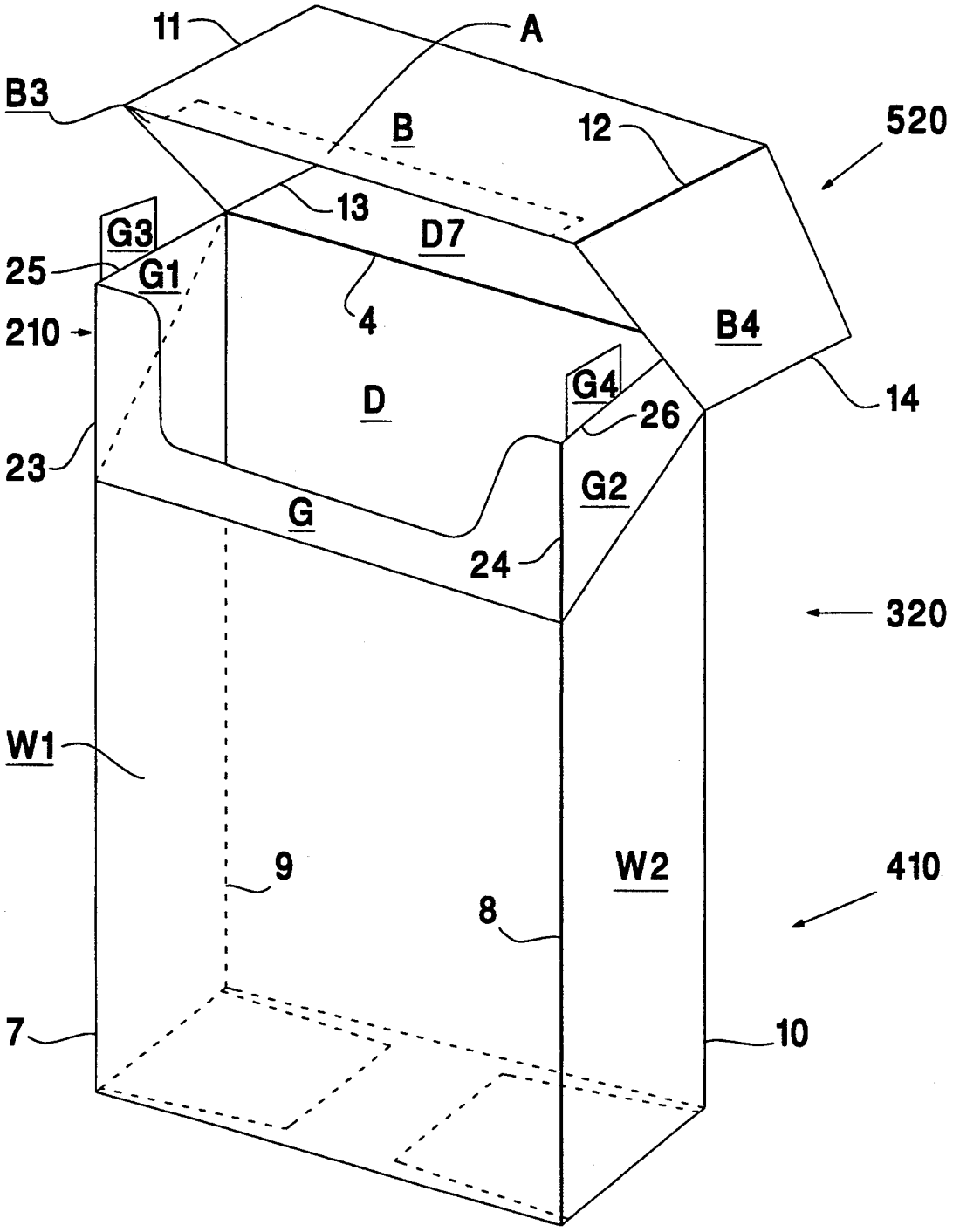
FIG. 4 is an isometric view of a hinged-lid cigarette pack with the top or lid pivoted back, having extension-type retention members in accordance with this invention in an unfolded, non-operational position.

A third embodiment of this invention is shown as cigarette pack 320 in FIG. 4 and is otherwise the same as FIG. 1 except for the following differences: extension-type retention members D5 and D6 are not present in lid 520 of cigarette pack 320. Slots 21*a* and 22*a* are not present in lower main portion 410 of cigarette pack 320. Instead, innerframe 210 of cigarette pack 320 has extension-type retention members G3 and G4 hinged along hinge lines 25 and 26, respectively. When extension-type retention members G3 and G4 are folded outward about hinge lines 25 and 26, respectively, such that they are substantially adjacent to the outer surfaces of innerframe left side wall G1 and innerframe right side wall G2, respectively, they provide additional interference between the inside surface of lid 520 and the outside surface of innerframe 210 to keep the lid firmly closed and resting on the top of the lower main portion 410, hence keeping the lid from opening accidentally.

Figure 5:
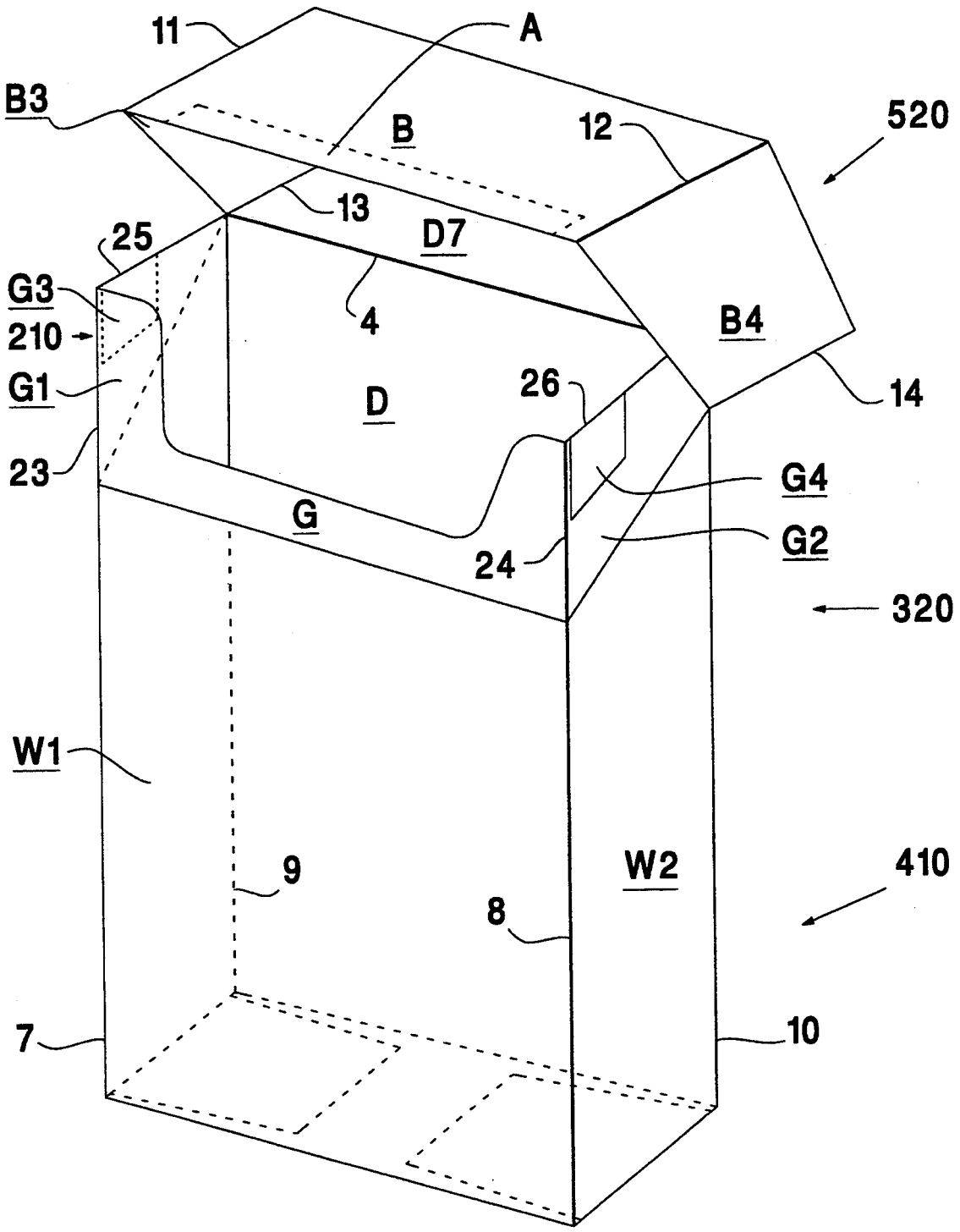
FIG. 5 is an isometric view of a cigarette pack with the top or lid pivoted back, having extension-type retention members in accordance with this invention in operational position.

An illustrative cigarette pack with the extension-type retention members of the third embodiment folded into operational position is shown in FIG. 5.

The extension-type retention members can be folded into operational position as in FIGS. 2, 3 and 5 and fixed (e.g., with glue) by the manufacturer. Alternatively, the manufacturer can provide the cigarette box to the consumer with the extension-type retention members in an unfolded, non-operational position and leave to the individual consumer's discretion the decision to fold the extension-type retention members into operational position as in FIGS. 2, 3 and 5.

Figure 6A:
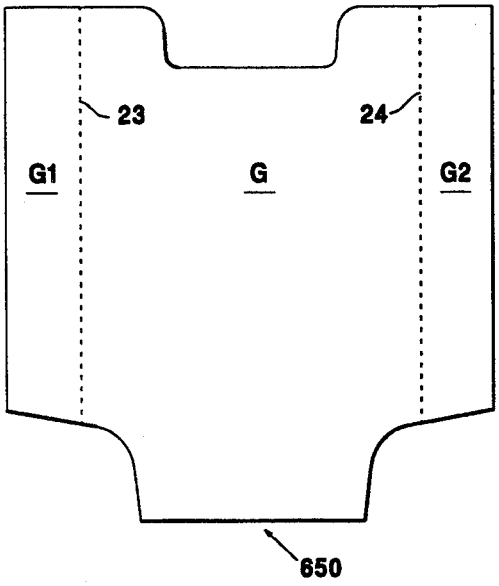
FIG. 6*a* is a plan view of an illustrative innerframe blank constructed in accordance with the principles of this invention.
Figure 6:
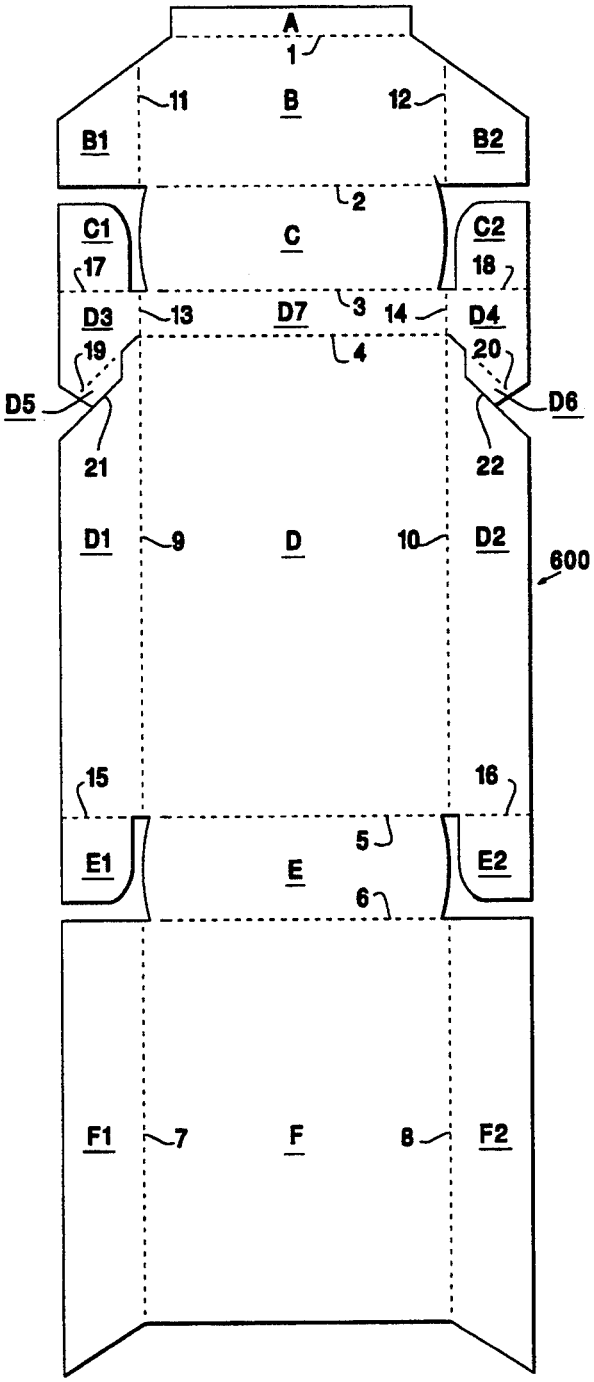
FIG. 6 is a plan view of an illustrated cigarette pack blank constructed in accordance with the principles of this invention.

An illustrative box blank 600 constructed in accordance with this invention is shown in plan view in FIG. 6. Blank 600 includes the following panels in top to bottom order: lid front wall reinforcement panel A, lid front wall panel B, lid top cover panel C, lid rear wall panel D7, main rear wall panel D, bottom cover panel E, main front wall panel F. The boundaries between these panels are as follows: between panels A and B, score line 1; between panels B and C, score line 2; between panels C and D7, score line 3; between panels D7 and D, score line 4; between panels D and E, score line 5; between panels E and F, score line 6. Score line 4 serves as the hinge line for the lid 500 in the constructed box.

Outer main side wall panels F1 and F2 extend from the left and right sides of panel F, respectively. Inner main side wall panels D1 and D2 extend from the left and right sides of panel D, respectively. Inner lid side wall panels D3 and D4 extend from the left and right sides of panel D7, respectively. Outer lid side wall panels B1 and B2 extend from the left and right sides of panel B, respectively. The boundaries between these panels are as follows: between panels F1 and F, score line 7; between panels F and F2, score line 8; between panels D1 and D, score line 9; between panels D and D2, score line 10; between panels D3 and D7, score line 13; between panels D7 and D4, score line 14; between panels B1 and B, score line 11; between panels B and B2, score line 12.

Bottom flap panels E1 and E2 extend down from inner main side wall panels D1 and D2, respectively. Lid flap panels C1 and C2 extend up from inner lid side wall panels D3 and D4, respectively. The boundaries between these panels are as follows: between panels E1 and D1, score line 15; between panels E2 and D2, score line 16; between panels C1 and D3, score line 17; between panels C2 and D4, score line 18.

Extension-type retention member panels D5 and D6 extend downward from panels D3 and D4, respectively. The boundaries between these panels are as follows: between panels D5 and D3, score line 19; between panels D6 and D4, score line 20.

Panels D3 and D5 are separated from panel D1 by cut line 21. Panels D4 and D6 are separated from panel D2 by cut line 22.

An illustrated innerframe blank 650 constructed in accordance with this invention is shown in plan view in FIG. 6*a*. Blank 650 includes the following panels: innerframe left side wall panel G1, innerframe front wall panel G, innerframe right side wall panel G2. The boundaries between these panels are as follows: between panels G1 and G, score line 23; between panels G and G2, score line 24.

The folded innerframe blank 650 can be attached (e.g., with glue) to the folded box blank 600 as in FIG. 1.

When folded and assembled, the illustrative box and innerframe blanks of FIG. 6 and FIG. 6*a* form a cigarette box in accordance with the first embodiment of this invention.

Figure 7A:
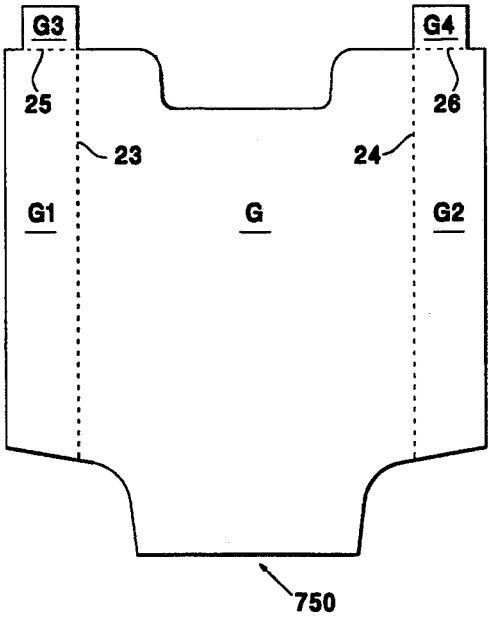
FIG. 7*a* is a plan view of an illustrative innerframe blank constructed in accordance with the principles of this invention.
Figure 7:
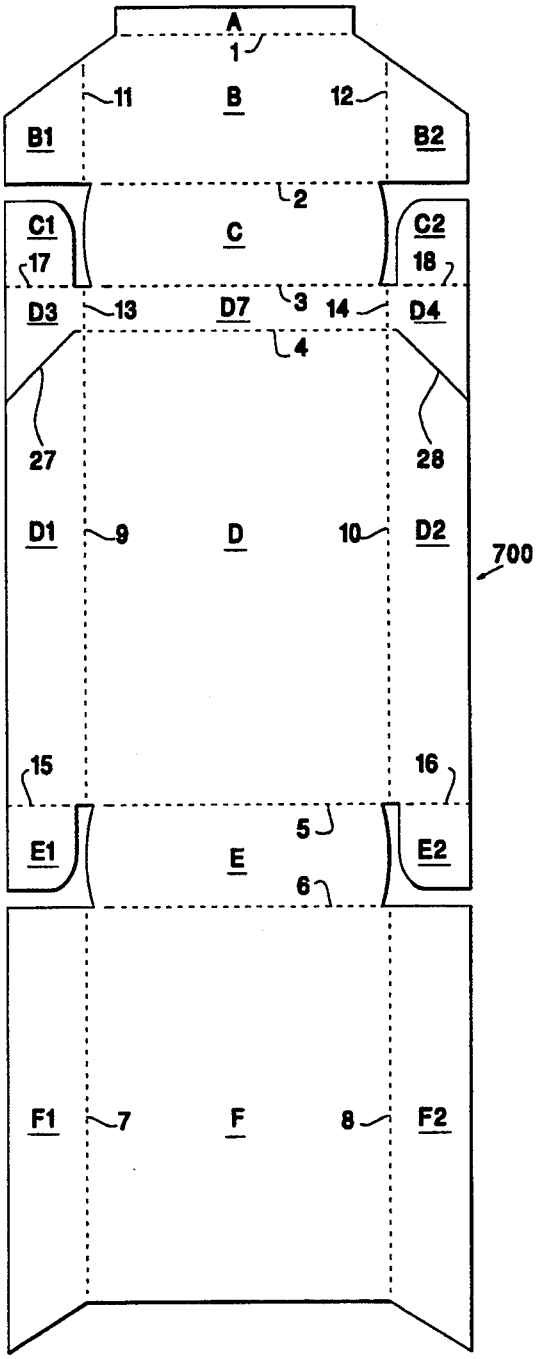
FIG. 7 is a plan view of an illustrated cigarette pack blank constructed in accordance with the principles of this invention.

A second illustrative box blank 700 constructed in accordance with this invention is shown in plan view in FIG. 7 and is otherwise the same as FIG. 6 except for the following differences: Panels D5 and D6 are not present in the blank of FIG. 7. Instead, the boundary between panels D1 and D3 is cut line 27, and the boundary between panels D2 and D4 is cut line 28.

A second illustrative innerframe blank 750 constructed in accordance with this invention is shown in plan view in FIG. 7*a* and is otherwise the same as FIG. 6*a* except for the following differences: Extension-type retention member panels G3 and G4 are shown in FIG. 7*a* extending upwardly from innerframe left side wall panel G1 and innerframe right side wall panel G2, respectively. The boundary between panels G1 and G3 is score line 25, and the boundary between panels G2 and G4 is score line 26.

The folded innerframe blank 750 can be attached (e.g. with glue) to the folded box blank 700 as in FIG. 4.

When folded and assembled, the illustrative box and innerframe blanks of FIG. 7 and FIG. 7*a* form a cigarette box in accordance with the third embodiment of this invention.

Figure 8:
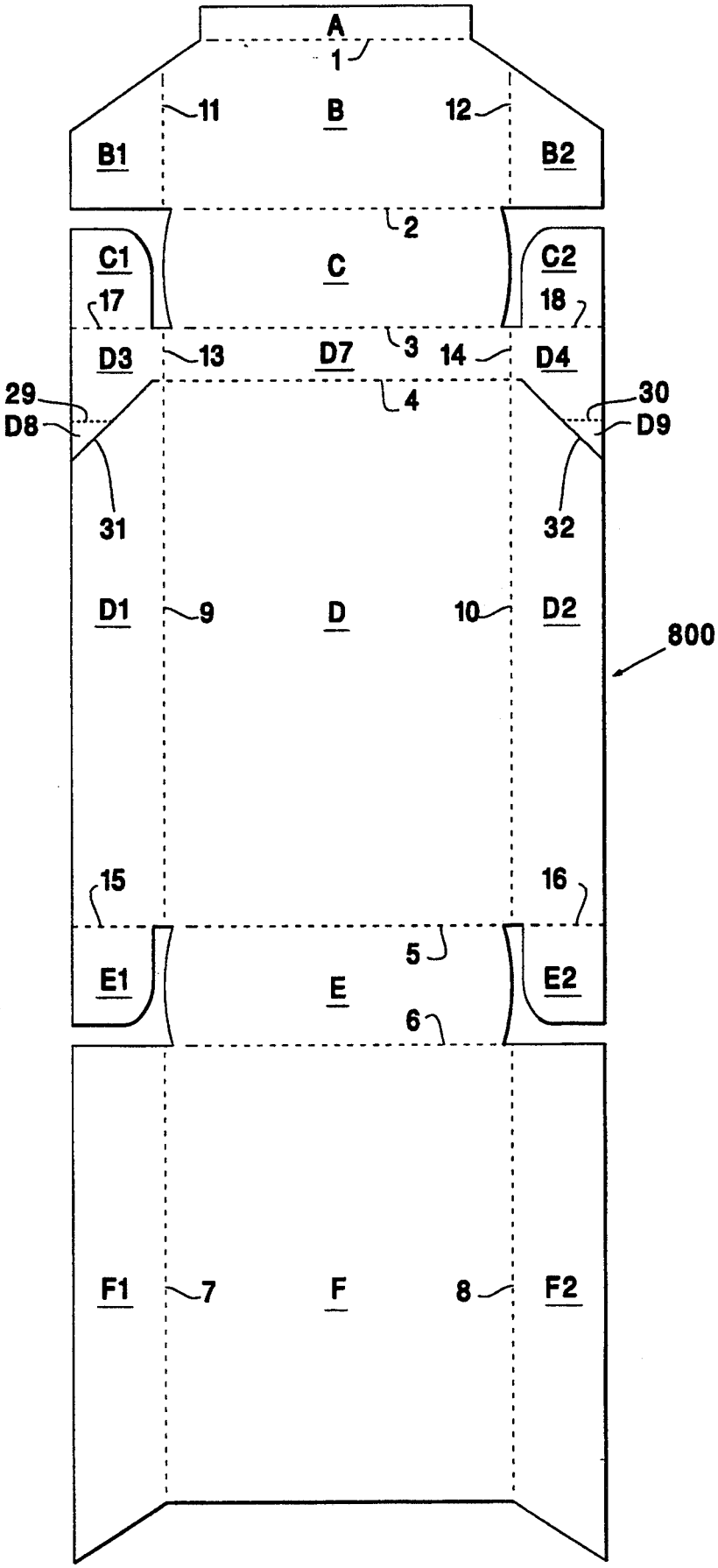
FIG. 8 is a plan view of an illustrated cigarette pack blank constructed in accordance with the principles of this invention.

A third illustrative box blank 800 constructed in accordance with this invention is shown in plan view in FIG. 8 and is otherwise the same as FIG. 7 except for the following differences: Retention member panels D8 and D9 extend downwardly from inner lid side wall panels D3 and D4, respectively. The boundary between panels D3 and D8 is score line 29, and the boundary between panels D4 and D9 is score line 30. Panels D3 and D8 are separated from panel D1 by cut line 31. Panels D4 and D9 are separated from panel D2 by cut line 32.

The folded innerframe blank 650 of FIG. 6*a* can be attached (e.g. with glue) to the folded box blank 800 as in FIG. 3.

When folded and assembled, the illustrative box and innerframe blanks of FIG. 8 and FIG. 6*a* form a cigarette box in accordance with the second embodiment of this invention.

The principles of this invention can be applied to cigarette boxes of any size (e.g., boxes of 10, 14, 20, 35, etc., cigarettes).

Although vertical edges 23, 24, 7, 8, 9, 10, 11, 12, 13, and 14 are shown as rounded or radiused, any or all may alternatively be formed as right-angled edges, and the retention feature of the present invention will operate equally well with boxes having right-angled corners.

Retention members D5 and D6, or G3 and G4, are shown as being trapezoidally shaped, but it will be understood that retention members D5 and D6, or G3 and G4, may be formed in any other convenient shape, such as a semicircle, a rectangle, a triangle, etc. Furthermore, any desired number of retention members may be provided. In the first embodiment, retention members may be hinged along the bottom edge of lid front wall B, inner lid side wall D3, inner lid side wall D4, the outer ply of lid side wall B3, or the outer ply of lid side wall B4. In the third embodiment, retention members may be hinged along the top edge of innerframe front wall G, side wall G1 or side wall G2.

Retention members D5 and D6 are shown in the first embodiment as hinged along the lower edges of inner lid side walls D3 and D4, respectively, but retention members may be hinged along the bottom edge of front wall B, the outer ply of lid side wall B3 or outer ply of lid side wall B4 in addition to or instead of retention members D5 and D6. Retention members G3 and G4 are shown in the third embodiment as hinged along the top edges of side walls G1 and G2 respectively, but retention members may be hinged along the top edge of innerframe front wall G in addition to or instead of retention members G1 and G2.

Two retention members, D8 and D9, are described in the second embodiment, but it will be understood that only one, or more than two, of retention members D8 and D9 may be used.

Retention members D5 and D6, D8 and D9, and G1 and G2, respectively, are depicted exclusively in the respective embodiments, but the retention members of each embodiment may also be used in combination with the retention members of either or both of the other embodiments.

Although lid 500 of the first disclosed embodiment is formed from the same blank as lower main portion 400 and hinged to lower main portion 400, lid 500 need not be formed from the same blank as lower main portion 400. Lid 500 may alternatively be fixed (e.g., with glue) to lower main portion 400 by a member such as a tab. Likewise, lids 510 and 520 of the second and third disclosed embodiments are formed from the same blank as lower main portion 410, and hinged to lower main portion 410. Lids 510 and 520 need not be formed from the same blank as lower main portion 410. Lids 510 and 520 may alternatively be fixed (e.g., with glue) to lower main portion 410 by a member such as a tab.

Furthermore, lid 500 need not be joined to outer member lower main portion 400 and alternatively may slide on and off over the innerframe rather than pivoting open and closed along a point of attachment. Likewise, lids 510 and 520 need not be joined to outer member lower main portion 410 and alternatively may slide on and off over the innerframe rather than pivoting open and closed along a point of attachment. In the event that lids 500, 510 and 520 slide on and off, retention members can be located elsewhere than on the sides of the pack. In particular, they may alternatively or in addition be located on the front or back of the pack.

The three described embodiments contemplate rectangular boxes. However, a box of any shape can be used (e.g., triangular, circular, pentagonal, octahedral, etc.).

Thus a hinged-lid cigarette box with fold-in lid locks to facilitate consistent lid closure is provided. One skilled in the art will appreciate that the present invention can be practiced by other than the described embodiments, which are presented for purposes of illustration and not of limitation, and the present invention is limited only by the claims which follow.

What is claimed is:

1. A pack for containing a plurality of cigarettes, said pack comprising:

a lower main portion having an inner surface facing the inside of the pack and an outer surface facing outwardly from the pack; wherein said lower main portion is substantially box-shaped having at least four substantially vertical walls and a bottom wall;

an innerframe member partly inside at least an upper portion of said lower main portion, said innerframe member having an inner surface facing the inside of the pack and an outer surface facing outwardly from the pack, at least a portion of said innerframe member extending above said lower main portion; wherein said innerframe member has at least one substantially vertical wall; and a lid having an inner surface facing the inside of the pack and an outer surface facing outwardly from the pack; wherein at least one of said innerframe member and said lid includes retention means for providing interference between said outer surface of said innerframe member and said inner surface of said lid to substantially prevent said lid from inadvertently opening to any degree; wherein said lid has a top wall and at least a substantially vertical front wall, a substantially vertical rear wall, a substantially vertical left side wall and a substantially vertical right side wall, each said wall having an inner surface facing the inside of the pack and an outer surface facing outwardly from the pack; and at least one of said right side wall and said left side wall of said lid includes said retention means for providing interference between said outer surface of said innerframe member and said inner surface of said lid to substantially prevent said lid from inadvertently opening to any degree; wherein:

said retention means comprises at least one tab member extending downwardly from a bottom edge of one of said right side wall and said left side wall of said lid;

said tab member can be folded about a hinge-line forming said bottom edge; and said folded tab member is substantially adjacent to said inner surface of one of said right side wall and said left side wall of said lid.

2. The pack of claim 1, wherein said tab member is trapezoidal in shape.

3. The pack of claim 1, wherein at least one of said tab members extends downwardly from each of said side walls of said lid.

4. The pack of claim 1, wherein said tab member fits between at least one of said substantially vertical walls of said lower main portion and one of said substantially vertical walls of said innerframe member when said tab member has not been folded and said lid is closed.

5. The pack of claim 1, wherein at least one of the substantially vertical corners formed by said substantially vertical walls of said lower main portion, said substantially vertical walls of said innerframe member and said substantially vertical walls of said outer member lid is radiused.

6. The pack of claim 1, wherein:

said side walls of said lid have inner panels in face-to-face contact with said inner surfaces of said side walls;

said inner panels each have an inner surface facing the inside of the pack; and at least one of said inner panels includes another retention means.

7. The pack of claim 6, wherein said other retention means comprises at least one segment of one of said inner panels folded along a hinge-line traversing the width of said inner panel; and said folded segment of said inner panel is substantially adjacent to the inner surface of said inner panel.

8. The pack of claim 6 wherein at least one of the substantially vertical corners formed by said substantially vertical walls of said lower main portion, said substantially vertical walls of said innerframe member and said substantially vertical walls of said outer member lid is radiused.

9. The pack of claim 1, wherein:

said innerframe member has at least a substantially vertical front wall, a substantially vertical left side wall and a substantially vertical right side wall, each said wall having an inner surface facing the inside of the pack and an outer surface facing outwardly from the pack; wherein at least one of said front wall, said right side wall and said left side wall of said innerframe member includes another retention means.

10. The pack of claim 9, wherein:

said other retention means comprises at least one other tab member extending upwardly from a top edge of said front wall, said right side wall and said left side wall of said innerframe member;

said other tab member can be folded about a hinge-line forming a top edge of said front wall, said right side wall and said left side wall of said innerframe member; and said other folded tab member is substantially adjacent to said outer surface of said front wall, said right side wall and said left side wall of said innerframe.

11. The pack of claim 10, wherein said other tab member is trapezoidal in shape.

12. The pack of claim 10, wherein at least one of said other tab members extends upwardly from each of said side walls of said innerframe member.

13. The pack of claim 9 wherein at least one of the substantially vertical corners formed by said substantially vertical walls of said outer member lower main portion, said substantially vertical walls of said innerframe member and said substantially vertical walls of said outer member lid is radiused.

14. A blank for forming a hinged lid cigarette box comprising:

a lid front wall reinforcement panel;

a lid front wall panel pivotably attached to said lid front wall reinforcement panel;

a lid top cover panel pivotably attached to said lid front wall panel;

a lid rear wall panel pivotably attached to said lid top cover panel;

a main rear wall panel pivotably attached to said lid rear wall panel;

a bottom cover panel pivotably attached to said main rear wall panel;

a main front wall panel pivotably attached to said bottom cover panel;

a left outer main side wall panel foldably attached to said main front wall panel;

a right outer main side wall panel foldably attached to said main front wall panel;

a left inner main side wall panel foldably attached to said main rear wall panel and having a top and a bottom edge;

a right inner main side wall panel foldably attached to said main rear wall panel and having a top and a bottom edge;

a left inner lid side wall panel foldably attached to said lid rear wall panel and having a top and a bottom edge;

a right inner lid side wall panel foldably attached to said lid rear wall panel and having a top and a bottom edge;

a left outer lid side wall panel foldably attached to said lid front wall panel;

a right outer lid side wall panel foldably attached to said lid front wall panel;

a left bottom flap panel pivotably attached to said bottom edge of said left inner main side wall panel;

a right bottom flap panel pivotably attached to said bottom edge of said right inner main side wall panel;

a left lid flap panel pivotably attached to said top edge of said left inner lid side wall panel; and a right lid flap panel pivotably attached to said top edge of said right inner lid side wall panel; wherein:

said blank is capable of being folded into a three-dimensional configuration such that:

said left inner main side wall panel is perpendicular to said main rear wall panel and to said main front wall panel, and parallel to and secured to said left outer main side wall panel;

said right inner main side wall panel is perpendicular to said main rear wall panel and to said main front wall panel, and parallel to and secured to said right outer main side wall panel;

said bottom cover panel is perpendicular to said main front wall panel, said main rear wall panel, said left inner main side wall panel, and said right inner main side wall panel;

said left bottom flap panel is perpendicular to said left inner side wall panel and parallel to and secured to said bottom cover panel;

said right bottom flap panel is perpendicular to said right inner side wall panel and parallel to and secured to said bottom cover panel;

said lid rear wall panel is adjacent to said main rear wall panel and perpendicular to said lid top cover panel;

said lid front wall panel is perpendicular to said lid top cover panel;

said lid front wall reinforcement panel is parallel to and secured to said lid front wall panel;

said left outer lid side wall panel is perpendicular to said lid front wall panel, said lid top cover panel and said lid rear wall panel;

said right outer lid side wall panel is perpendicular to said lid front wall panel, said lid top cover panel and said lid rear wall panel;

said left inner lid side wall panel is perpendicular to said lid front wall panel, said lid top cover panel, said lid rear wall panel and parallel to and secured to said left outer lid side wall panel;

said right inner lid side wall panel is perpendicular to said lid front wall panel, said lid top cover panel, said lid rear wall panel and parallel to and secured to said right outer lid side wall panel;

said left lid flap panel is perpendicular to said left inner lid side wall panel and parallel to and secured to said lid top cover panel; and said right lid flap panel is perpendicular to said right inner lid side wall panel and parallel to and secured to said lid top cover panel.

15. The blank of claim 14 wherein said blank is made of paperboard.

16. The blank of claim 14, further comprising:

a left extension retention member pivotably attached to said bottom edge of said left inner lid side wall panel and formed by cutting out a portion of said left inner main side wall panel; and a right extension retention member pivotably attached to said bottom edge of said right inner lid side wall panel and formed by cutting out a portion of said right inner main side wall panel; wherein:

said left extension retention member, when folded, is parallel to and abutted against said left inner lid side wall panel; and said right extension retention member, when folded, is parallel to and abutted against said right inner lid side wall panel.

17. A hinged-lid cigarette box having vertical edges formed by inserting into said three-dimensional configuration formed by folding said blank of claim 16 a three-dimensional innerframe formed by folding an innerframe blank comprising:

an innerframe front wall panel having a top and a bottom edge;

an innerframe left side wall panel foldably attached to said innerframe front wall panel; and an innerframe right side wall panel foldably attached to said innerframe front wall panel; wherein:

said inner innerframe left side wall panel is perpendicular to said innerframe front wall panel;

said innerframe right side wall panel is perpendicular to said innerframe front wall panel;

said innerframe front wall panel is parallel to and secured to said main front wall panel;

said innerframe left side wall panel is parallel to and secured to said left inner main side wall panel; and said innerframe right side wall panel is parallel to and secured to said right inner main side wall panel.

18. The hinged-lid cigarette box of claim 17 wherein said vertical edges are radiused.

19. A hinged-lid cigarette box having vertical edges formed by inserting into said three-dimensional configuration formed by folding said blank of claim 14 a three-dimensional innerframe formed by folding an innerframe blank comprising:

an innerframe front wall panel having a top and bottom edge;

an innerframe left side wall panel foldably attached to said innerframe front wall panel having a top and a bottom edge;

an innerframe right side wall panel foldably attached to said innerframe front wall panel having a top and a bottom edge;

a left extension retention member pivotably attached to said top edge of said innerframe left side wall panel; and a right extension retention member pivotably attached to said top edge of said innerframe right side wall panel; wherein:

said innerframe left side wall panel is perpendicular to said innerframe front wall panel;

said innerframe right side wall panel is perpendicular to said innerframe front wall panel;

said left extension retention member, when folded, is parallel to and abutted against said innerframe left side wall panel;

said right extension retention member, when folded, is parallel to and abutted against said innerframe right side wall panel;

said innerframe front wall panel is parallel to and secured to said main front wall panel;

said innerframe left side wall panel is parallel to and secured to said left inner main side wall panel; and said innerframe right side wall panel is parallel to and secured to said right inner main side wall panel.

20. The hinged-lid cigarette box of claim 19 wherein said vertical edges are radiused.

21. The blank of claim 14 further comprising:

a left retention member panel pivotably attached to said left inner lid side wall panel; and a right retention member panel pivotably attached to said right inner lid side wall panel; wherein:

said left retention member panel, when folded, is parallel to and abutted against said left inner lid side wall panel; and said right retention member panel, when folded, is parallel to and abutted against said right inner lid side wall panel.

22. A hinged-lid cigarette box having vertical edges formed by inserting into said three-dimensional configuration formed by folding said blank of claim 21 a three-dimensional innerframe formed by folding an innerframe blank comprising:

an innerframe front wall panel having a top and a bottom edge;

an innerframe left side wall panel foldably attached to said innerframe front wall panel; and an innerframe right side wall panel foldably attached to said innerframe front wall panel; wherein:

said inner innerframe left side wall panel is perpendicular to said innerframe front wall panel;

said innerframe right side wall panel is perpendicular to said innerframe front wall panel;

said innerframe front wall panel is parallel to and secured to said main front wall panel;

said innerframe left side wall panel is parallel to and secured to said left inner main side wall panel; and said innerframe right side wall panel is parallel to and secured to said right inner main side wall panel.

23. The hinged-lid cigarette box of claim 22 wherein said vertical edges are radiused.

24. A blank for forming an innerframe for a hinged-lid cigarette box comprising:

an innerframe front wall panel having a top and a bottom edge;

an innerframe left side wall panel foldably attached to said innerframe front wall panel having a top and a bottom edge;

an innerframe right side wall panel foldably attached to said innerframe front wall panel having a top and a bottom edge; wherein:

said blank is capable of being folded into a three-dimensional configuration such that:

said inner innerframe left side wall panel is perpendicular to said innerframe front wall panel; and said innerframe right side wall panel is perpendicular to said innerframe front wall panel, and further comprising:

a left extension retention member pivotably attached to said top edge of said innerframe left side wall panel;

a right extension retention member pivotably attached to said top edge of said innerframe right side wall panel; wherein:

said left extension retention member, when folded, is parallel to and abutted against said innerframe left side wall panel; and said right extension retention member, when folded, is parallel to and abutted against said innerframe right side wall panel.

25. The blank of claim 24 wherein said blank is made of paperboard.

26. A pack for containing a plurality of cigarettes, said pack comprising:

a lower main portion having an inner surface facing the inside of the pack and an outer surface facing outwardly from the pack; wherein said lower main portion is substantially box-shaped having at least four substantially vertical walls and a bottom wall;

an innerframe member partly inside at least an upper portion of said lower main portion, said innerframe member having an inner surface facing the inside of the pack and an outer surface facing outwardly from the pack, at least a portion of said innerframe member extending above said lower main portion; wherein said innerframe member has at least a substantially vertical front wall, a substantially vertical left side wall and a substantially vertical right side wall, each said wall having an inner surface facing the inside of the pack and an outer surface facing outwardly from the pack;

a lid having an inner surface facing the inside of the pack and an outer surface facing outwardly from the pack; wherein said lid has a top wall and at least a substantially vertical front wall, a substantially vertical rear wall, a substantially vertical left side wall and a substantially vertical right side wall, each said wall having an inner surface facing the inside of the pack and an outer surface facing outwardly from the pack; and wherein at least one of said innerframe member and said lid includes retention means for providing interference between said outer surface of said innerframe member and said inner surface of said lid to substantially prevent said lid from inadvertently opening to any degree; and wherein at least one of said front wall, said right side wall and said left side wall of said innerframe member includes said retention means;

wherein said retention means comprises at least one tab member extending upwardly from a top edge of said front wall, said right side wall and said left side wall of said innerframe member;

wherein said tab member can be folded about a hinge-line forming a top edge of said front wall, said right side wall and said left side wall of said innerframe member; and said folded tab member is substantially adjacent to said outer surface of said front wall, said right side wall and said left side wall of said innerframe.

27. The pack of claim 26, wherein said tab member is trapezoidal in shape.

28. The pack of claim 26, wherein at least one of said tab members extends upwardly from each of said side walls of said innerframe member.

29. The pack of claim 26, wherein:

at least one of said front wall, said rear wall, said right side wall and said left side wall of said lid includes another retention means for providing interference between said outer surface of said innerframe member and said inner surface of-said lid to substantially prevent said lid from inadvertently opening to any degree.

30. The pack of claim 29, wherein:

said other retention means comprises at least one other tab member extending downwardly from a bottom edge of one of said front wall, said rear wall, said right side wall, and said left side wall of said lid;

said other tab member can be folded about a hinge-line forming said bottom edge; and said other tab member is substantially adjacent to said inner surface of one of said front wall, said rear wall, said right side wall and said left side wall of said lid.

31. The pack of claim 30, wherein said other tab member is trapezoidal in shape.

32. The pack of claim 30, wherein at least one of said other tab members extends downwardly from each of said side walls of said lid.

33. The pack of claim 30, wherein said other tab member fits between at least one of said substantially vertical walls of said lower main portion and one of said substantially vertical walls of said innerframe member when said other tab member has not been folded and said lid is closed.

34. The pack of claim 29, wherein at least one of the substantially vertical corners formed by said substantially vertical walls of said lower main portion, said substantially vertical walls of said innerframe member and said substantially vertical alls of said outer member lid is radiused.

35. The pack of claim 26, wherein:

said side walls of said lid have inner panels in face-to-face contact with said inner surfaces of said side walls;

said inner panels each have an inner surface facing the inside of the pack; and at least one of said inner panels includes another retention means.

36. The pack of claim 35, wherein said other retention means comprises at least one segment of one of said inner panels folded along a hinge-line traversing the width of said inner panel; and said folded segment of said inner panel is substantially adjacent to the inner surface of said inner panel.

37. The pack of claim 35, wherein at least one of the substantially vertical corners formed by said substantially vertical walls of said lower main portion, said substantially vertical walls of said innerframe member and said substantially vertical walls of said outer member lid is radiused.

38. The pack of claim 26, wherein at least one of the substantially vertical corners formed by said substantially vertical corners formed by said substantially vertical walls of said outer member lower main portion, said substantially vertical walls of said innerframe member and said substantially vertical walls of said outer member lid is radiused.

39. A pack for containing a plurality of cigarettes, said pack comprising:

a lower main portion having an inner surface facing the inside of the pack and an outer surface facing outwardly from the pack; wherein said lower main portion is substantially box-shaped having at least four substantially vertical walls and a bottom wall;

an innerframe member partly inside at least an upper portion of said lower main portion, said innerframe member having an inner surface facing the inside of the pack and an outer surface facing outwardly from the pack, at least a portion of said innerframe member extending above said lower main portion; wherein said innerframe member has at least one substantially vertical wall;

a lid having an inner surface facing the inside of the pack and an outer surface facing outwardly from the pack; wherein:

at least one of said innerframe member and said lid includes retention means for providing interference between said outer surface of said innerframe member and said inner surface of said lid to substantially prevent said lid from inadvertently opening to any degree;

said lid has a top wall and at least a substantially vertical front wall, a substantially vertical rear wall, a substantially vertical left side wall and a substantially vertical right side wall, each said wall having an inner surface facing the inside of the pack and an outer surface facing outwardly from the pack;

said side walls of said lid have inner panels in face-to-face contact with said inner surfaces of said side walls;

said inner panels each have an inner surface facing the inside of the pack; and at least one of said inner panels includes said retention means; wherein said retention means comprises a tab member extending downwardly from a bottom edge of one of said inner panels, wherein said tab member can be folded about a hinge-line formed by a hinge-line forming said bottom edge, wherein said folded tab member is substantially adjacent to said inner surface of one of said inner panels.

40. The pack of claim 39, wherein at least one of said tab members extends downwardly from each of said inner panels.

41. The pack of claim 39, wherein:

at least one of said front wall, said rear wall, said right side wall and said left side wall of said lid includes another retention means for providing interference between said outer surface of said innerframe member and said inner surface of said lid to substantially prevent said lid from inadvertently opening to any degree.

42. The pack of claim 41, wherein:

said other retention means comprises at least one other tab member extending downwardly from a bottom edge of one of said front wall, said rear wall, said right side wall and said left side wall of said lid;

said other tab member can be folded about a hinge-line forming said bottom edge; and said folded other tab member is substantially adjacent to said inner surface of one of said front wall, said rear wall, said right side wall and said left side wall of said lid.

43. The pack of claim 42 wherein said other tab member is trapezoidal in shape.

44. The pack of claim 42, wherein at least one of said other tab members extends downwardly from each of said side walls of said lid.

45. The pack of claim 42, wherein said other tab member fits between at least one of said substantially vertical walls of said lower main portion and one of said substantially vertical walls of said innerframe member when said tab member has not been folded and said lid is closed.

46. The pack of claim 41, wherein at least one of the substantially vertical corners formed by said substantially vertical walls of said lower main portion, said substantially vertical walls of said innerframe member and said substantially vertical walls of said outer member lid is radiused.

47. The pack of claim 40, wherein at least one of the substantially vertical corners formed by said substantially vertical walls of said lower main portion, said substantially vertical walls of said innerframe member and said substantially vertical walls of said outer member lid is radiused.

48. The pack of claim 40, wherein:

said innerframe member has at least a substantially vertical front wall, a substantially vertical left side wall and a substantially vertical right side wall, each said wall having an inner surface facing the inside of the pack and an outer surface facing outwardly from the pack; wherein at least one of said front wall, said right side wall and said left side wall of said innerframe member includes another retention means.

49. The pack of claim 48, wherein:

said other retention means comprises at least one other tab member extending upwardly from a top edge of said front wall, said right side wall and said left side wall of said innerframe member;

said other tab member can be folded about a hinge-line forming a top edge of said front wall, said right side wall and said left side wall of said innerframe member; and said folded other tab member is substantially adjacent to said outer surface of said front wall, said right side wall and said left side wall of said innerframe.

50. The pack of claim 49, wherein said other tab member is trapezoidal in shape.

51. The pack of claim 49, wherein at least one of said other tab members extends upwardly from each of said side walls of said innerframe member.

52. The pack of claim 49, wherein at least one of the substantially vertical corners formed by said substantially vertical walls of said outer member lower main portion, said substantially vertical walls of said innerframe member and said substantially vertical walls of said outer member lid is radiused.

* * * * *